United States Patent [19]

Klein

[11] 4,011,696

[45] Mar. 15, 1977

[54] MULTIPLE-LINE SOFFIT SYSTEM

[75] Inventor: Carlton Klein, New York, N.Y.

[73] Assignee: New York Flameproofing Company, Inc., New York, N.Y.

[22] Filed: July 17, 1973

[21] Appl. No.: 380,069

[52] U.S. Cl. ..... 52/39; 52/484; 16/87.4 R

[51] Int. Cl.[2] ..... B09F 7/19

[58] Field of Search ..... 52/39, 484, 476, 498, 52/501; 16/96 D, 94 D; 160/345, 19

[56] References Cited

UNITED STATES PATENTS

| | | | |
|---|---|---|---|
| 3,222,839 | 12/1965 | Philpot | 52/498 |
| 3,297,075 | 1/1967 | Howell et al. | 160/19 |
| 3,574,887 | 4/1971 | Schindlaver | 160/19 X |
| 3,587,131 | 6/1971 | Graf | 160/345 X |
| 3,596,425 | 8/1971 | Kodaras | 52/484 X |
| 3,708,927 | 1/1973 | Cohen | 52/39 |

*Primary Examiner*—Price C. Faw, Jr.
*Assistant Examiner*—Carl D. Friedman

[57] ABSTRACT

A multiple-line soffit system for supporting wall and window coverings such as blinds or draperies. The system is constituted by a series of interlocked modules having planar faces which extend from the perimeter wall into the room area, the modules being supported from an overhead structure by hooks or other means. Each module serving as a supporting fixture for a window or wall covering is provided with a recessed channel having a narrow entrance defined by a fixed ledge and a gate spaced from the ledge to create a linear slit extending the full length of the module. The ledge and gate lie flush with the face of the module to provide a surface free of projections. The gate is adapted to swing inwardly to admit a head piece, control cords and rollers or whatever other hardware is entailed, whereby to install a covering, all that need be done is to lift the gate to permit insertion of the hardware into the channel, the gate then being returned to its normal position to entrap the hardware.

4 Claims, 6 Drawing Figures

MULTIPLE-LINE SOFFIT SYSTEM

BACKGROUND OF THE INVENTION

This invention relates generally to soffit systems for supporting window and wall coverings, and more particularly to a multiple-line soffit system having recessed channels operating in conjunction with retractable gates to define pockets or tracks for receiving the hardware associated with draperies, blinds, shades and other types of coverings.

Ordinarily, in order to mount venetian blinds or draperies, it is necessary to attach suitable rods or fixtures onto the ceiling or wall. The nature of these fixtures depends on the type of covering hardware involved. In the case of shiftable draperies which can be drawn to curtain window, a track must be provided to conduct the drapery rollers or carriers, whereas in the case of venetian blinds, the fixture must be adapted to accommodate and hold the head piece of the blind assembly. These fixtures are therefore expressly designed and dimensioned for a specific covering.

Installation costs for conventional fixtures are high, for the installer must measure the available space and must cut or otherwise adapt an appropriate fixture to occupy this space. It is not at all unusual to find that installation costs exceed the cost of the draperies.

Custom-installed fixtures for wall and window coverings are objectionable from several standpoints. A major objection is that the fixtures have to be tailored to meet specific requirements. Also because the fixtures are generally exposed, they are often conspicuous and unsightly. This is incompatible with the modern architectural trend which is toward clean sight lines. Moreover in many modern interiors, particularly in office buildings, flexible partitioning arrangements are provided to facilitate the sub-division of a room to meet changing requirements. The existence of exposed ceiling fixtures may interfere with changes in the partition pattern, for the position of an installed fixture cannot be readily shifted.

To overcome the drawbacks of conventional fixtures, master recessed channel systems have heretofore been developed, taking the form of pre-cut aluminum extrusions having pockets or channels adapted to receive the covering hardware. Such systems offer many advantages to architects and interior designers, for the systems make possible a new design freedom in the handling of window and wall treatments and are adaptable to all types of blinds (horizontal and vertical), draperies and shades.

Installation costs for recessed channel systems are markedly lower than for conventional fixtures in that there is no need for brackets, screws and other attachment elements to join the covering hardware to the fixtures. However, the recessed channels are completely open and it is necessary therefore, in the case of the head pieces for venetian blinds, to provide removable grounding plates to hold the head pieces within the channels. And in the case of draperies, it is necessary to snap in track elements into the channels. Hence this known type of recessed channel system is not self contained, for it requires auxiliary pieces to complete an installation. Moreover, to install track elements into these channels, they must be cut to size. Should a change be made such as extending the room dimension by a partition shift, the previously installed track elements are not reusable and new elements must be cut.

SUMMARY OF THE INVENTION

In view of the foregoing, it is the main object of the present invention to provide an improved multi-line soffit system constituted by a series of interlocking modules, each track module including a recessed channel having a retractable gate adapted to receive and hold hardware for wall and window coverings.

A significant advantage of the invention is that the system is self-contained and requires no auxiliary pieces such as separate track elements or grounding plates, in that the gated channels serve as tracks or pockets for the hardware.

More specifically it is an object of the invention to provide a soffit system of the above-noted type wherein each track module includes end connector sections which are adapted to interlock with complementary sections on the adjoining modules, so that various types of systems may be created which include air-diffuser and lighting modules as well as track modules for window coverings.

Because the soffit system in accordance with the invention is self-contained, it allows the builder to erect ceilings and walls in advance of the selection of window and wall coverings, and even before the installation of office partitions, for by extending a soffit system along the full length of the perimeter wall with at least two track modules and one or more modules for ventilation or other purposes, one then has available channels and pockets for whatever coverings or air diffusers are later selected. The resultant savings to the builder are considerable, for all window coverings are immediately self-supporting, and no grounding devices or track elements need be inserted.

Briefly stated, these objects are attained in a soffit system formed by a series of interlocking modules all of which have planar faces, the modules serving as pockets or tracks to support window coverings. Each module includes a recessed channel with a narrow entrance defined by a fixed ledge and a gate spaced from the ledge to create an inconspicuous linear slit extending the full length of the module, the ledge and gate lying flush with the face of the module to provide a clear surface free of projections. The gate is adapted to swing inwardly to admit a head piece, control cords and rollers, or whatever other hardware is entailed, whereby to install a covering all that need be done is to lift the gate to permit insertion of the hardware into the channel, the gate then being returned to its normal position to entrap the hardware in the channel.

OUTLINE OF THE DRAWING

For a better understanding of the invention as well as other objects and further features thereof, reference is made to the following detailed description to be read in conjunction with the accompanying drawing wherein.

Figure 4:
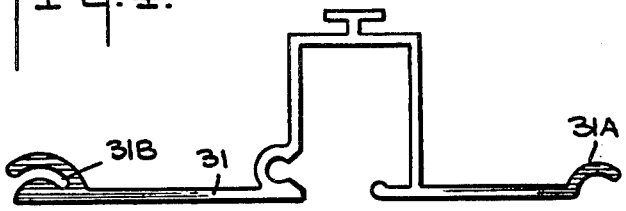
Figure 5:
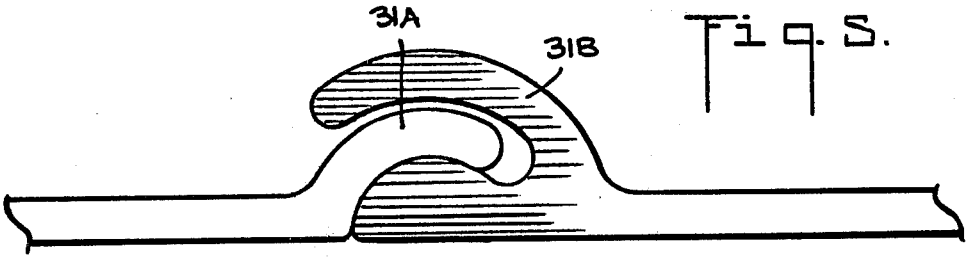
Figure 6:
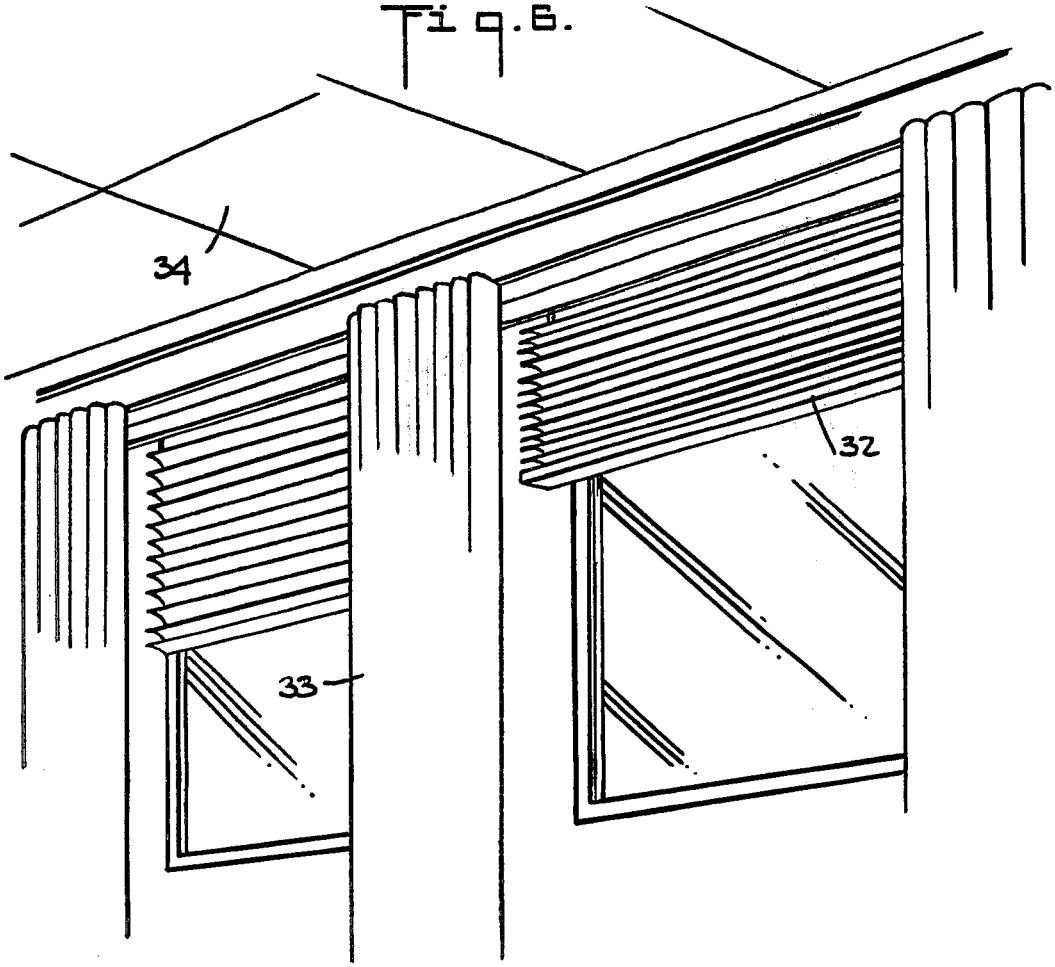

FIG. 4 shos, in end view, an alternative form of track module;

FIG. 5 is a detail showing the junction of two modules of the type illustrated in FIG. 4; and FIG. 6 illustrates a room installation of a system in accordance with the invention, formed by a pair of track modules.

DESCRIPTION OF THE INVENTION

Figure 1:
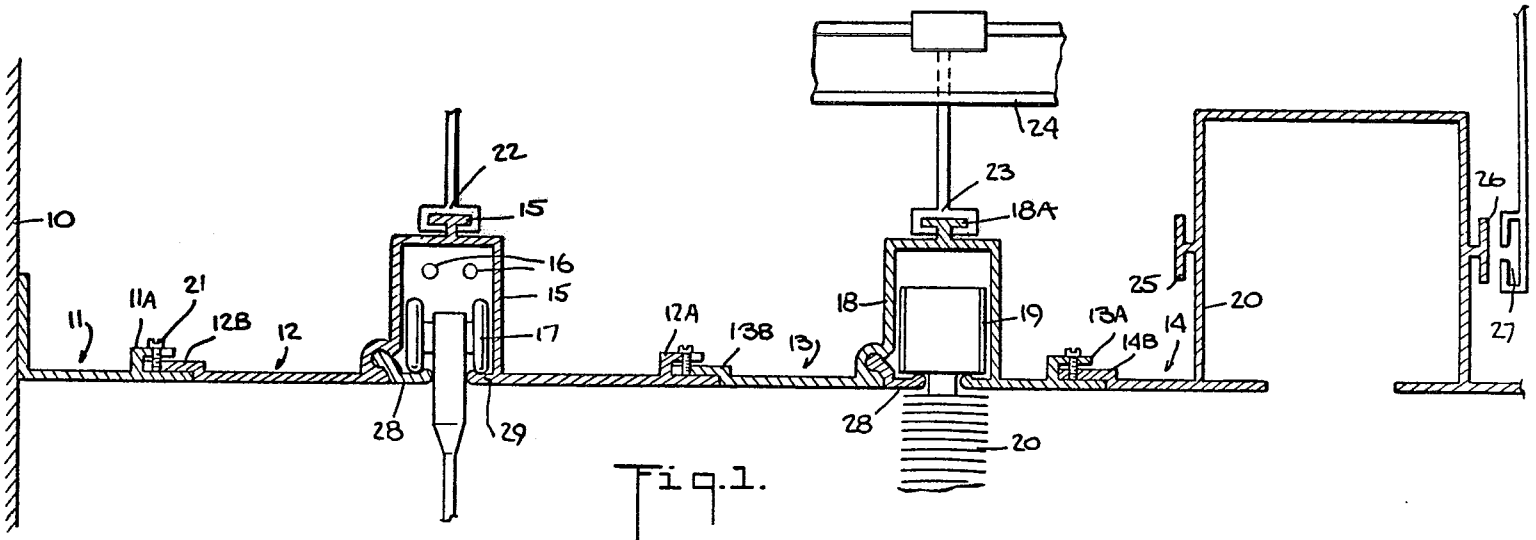
FIG. 1 is a transverse section taken through a multi-line soffit system formed of interlocking modules.
Figure 3:
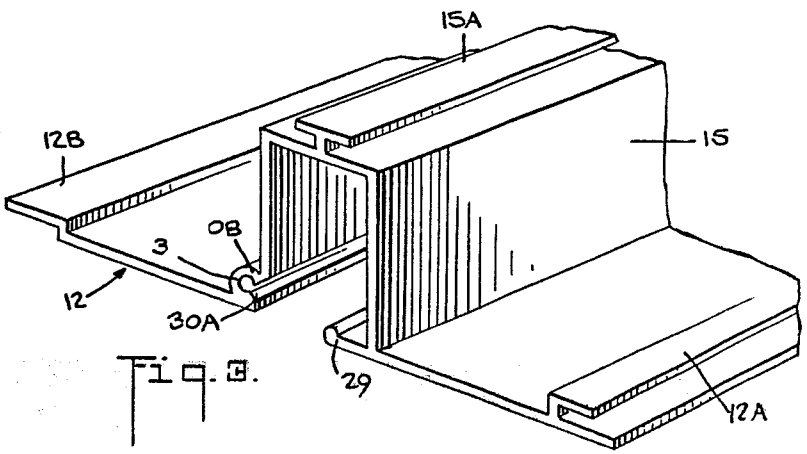
FIG. 3 is a perspective view of one of the track modules.

Referring now to FIG. 1, there is shown a preferred embodiment of a multiple-line soffit system in accordance with the invention. The system is constituted by a series of interlocked modules extending from the window line or perimeter wall 10 into the room area to an extent determined by the number of modules forming the system.

The system shown is composed of a bracket module 11, a first track module 12, an identical second track module 13 and an air-diffuser module 14. The first track module 12 is provided with a recessed channel 15 having a rectangular cross section which is useable as a pocket or trackway to accommodate the rollers, the carriers and cord controls and whatever other hardware components are required to support or hang draperies, blinds, shades or any other form of window or wall covering. In the example shown, channel 15 accommodates the control cords 16 and rollers 17 for draperies.

The second track module 13 is provided with a recessed channel 18 which, by way of example, is shown as accommodating the head piece 19 of a venetian blind 20. The air-diffuser module 14 is provided with a relatively large recessed channel 14' adapted to receive air-diffuser elements for ventilation purposes.

The bracket module 11 has an L-shaped formation, the vertical leg of which is attachable by bolts or other suitable means to the perimeter wall 10. The horizontal leg of bracket module 11 terminates in a groove section 11A which is adapted to receive the complementary tongue section 12B of the first track module 12, the tongue section being at the left end of this module.

The right end of the first track module 12 terminates in a groove section 12A which receives the complementary tongue section 13B of the second track module 13, the other end of this module having a groove section 13A which receives the tongue section 14B of the module 14. The tongue and groove joints of the system are secured together by suitable rivets 21. Thus the soffit system not only includes one or more modules serving as tracks or pockets for window covering hardware, but it may also include additional modules for air diffusion ducts, lighting fixtures or other facilities called for in a given room installation. The number and types of modules forming the system are determined by particular room requirements.

The multiple-line soffit system is suspended from an overhead structure. To facilitate such suspension, channel 15 is provided at its top with a T-shaped coupling head 15A to which is connected a hanger 22 having a complementing form. Similarly, channel 18 is provided with a coupling head 18A to which is connected a hanger 23. These hangers may be attached to suitable overhead supports, such as beam 24.

Alternatively the hangers may be in cable form for connection to appropriate sockets. In the case of the larger channel 20, a pair of lateral coupling heads 25 and 26 are provided, these heads having a T-shape. These heads cooperate with complementary lateral hangers, such as hanger 27. The lengths of the hangers are such as to align the soffit system with a dropped ceiling which may be formed of acoustical tiles, panels or whatever other ceiling material is used.

In order to make it possible to introduce the hardware components of the window or wall covering into the recessed channels of the track modules and to entrap the components therein without the need for auxiliary pieces, each track module is provided with a narrow, slit-like entrance which extends its full length. The entrance is defined by a gate 28 pivoted on one side of the channel and projecting laterally therefrom, and a fixed ledge 29 projecting from the other side thereof, the free end of the ledge being spaced from the free end of the gate to create the narrow entrance. The exposed surface of ledge 29 is flush with the planar face of the module, and the exposed surface of gate 28, in its normal or closed position, is similarly flush with the module face, so that the module presents a flat surface free of projections.

Figure 2:
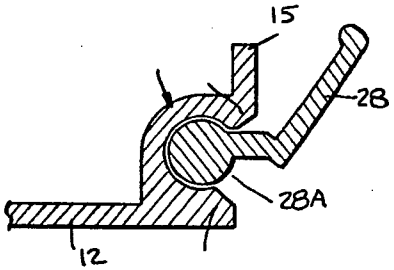
FIG. 2 is a detail of the retractable gate included in the track modules.

The configuration of gate 28 and the preferred manner in which it is pivoted is best seen in FIG. 2. Gate 28 is provided with a bead 28A having a circular cross section, the bead being socketed within a concave recess 30 formed at the left junction of channel 15 and the wall of module 12. The lower end of recess 30 is provided with a shoulder 30A, and the upper end with a shoulder 30B. Thus when the gate occupies its closed position, link section 28B thereof abuts shoulder 30A, and when the gate is lifted to provide access to the channel, link section 28B abuts shoulder 30B. Thus the shoulders constitute the limits of gate movement. All that need be done to install hardware components is to raise the gate to enlarge the entrance to the channel to permit the admission of the components and then to drop and close the gate to entrap the components.

Gate 28 is preferably made of a synthetic plastic material such as Delran or Telfon having a low coefficient of friction so that it functions effectively as a self lubricating trackway. Ledge 29 is preferably coated with a similar material for the same purpose. Thus the rollers or other moving or sliding components move with ease along the track and with minimum wear. The module itself is preferably fabricated of extruded aluminum which is made in stock lengths and cut to the required size. The width of the system depends of course on how many modules are interlocked.

The track module 31 shown in FIGS. 4 and 5 differs from that in FIG. 1 only in the nature of the interlocking elements. The module is provided at its left end with a groove section 31B having a curved formation which complements the arcuate tongue section 31A formed at the right end.

A typical installation in which the multiple-line soffit system is constituted by only two track sections is shown in FIG. 5 where it will be seen that the system is extended along the windows of the room and has two operating lines, one supporting venetian blinds 32 and the other draperies 33. The system is flush with a dropped ceiling 34 formed by an array of acoustical panels.

While there has been shown preferred embodiments of the invention, it will be appreciated that many changes may be made therein without departing from the spirit of the invention.

For example, in the embodiments shown and described, each track module makes use of a pivoted gate in combination with a fixed ledge to form the entrance to the channel to admit hardware therein. In practice, in lieu of a fixed ledge, the extrusion may be formed to support a second pivoted gate identical to the first gate. In this way a larger access opening is provided which may be necessary with certain types of hardware. The free edges of the gates have round lips serving as the edges of a trackway.

What I claim is:

1. A soffit system for supporting wall and window coverings having hardware components from which the coverings are suspended, said system comprising a series of like interlocking track modules fabricated of extruded aluminum, each including a recessed channel having a narrow entrance extending the full length of the module, said entrance being defined by a gate pivoted on one side of the channel and adapted to swing inwardly and a ledge projecting from the other side of the channel and spaced from the gate to form said narrow entrance, said module having a recess formed at the junction of the channel and the module wall to define an arcuate socket extending the full length of the module, said gate being formed of a plastic material having a relatively low coefficient of friction and having a bead at one edge extending the full length thereof which is received in said socket to create a hinge requiring no pin, said gate being liftable to admit the hardware components of a particular covering into said channel whereby when said gate is thereafter closed, it entraps the components, each module having at its ends complementary joining elements whereby adjoining elements may be interlocked to provide as many channels as is required by the window and wall coverings, said module channel having integral therewith at its top a coupling head with a T-formation which extends the full length of the module whereby said module may be supported from an overhead structure by means of hangers having a complementary formation.

2. A soffit system as set forth in claim 1, wherein said joining elements are of the tongue and groove type.

3. A system as set forth in claim 1, wherein said ledge is constituted by a pivoted gate identical to the first gate whereby the entrance is defined by a pair of gates which are liftable to admit said hardware.

4. A system as set forth in claim 1, wherein the free edge of the gate is formed with a rounded lip.

* * * * *